US006422179B2

(12) United States Patent
Hughes et al.

(10) Patent No.: US 6,422,179 B2
(45) Date of Patent: Jul. 23, 2002

(54) WATER HEATER FLUE SYSTEM

(75) Inventors: Dennis R. Hughes, Hartford; Marc W. Akkala, Cedarburg; Kevin M. Field, Oconomowoc; Robert F. Poehlman, South Milwaukee, all of WI (US)

(73) Assignee: AOS Holding Company, Wilmington, DE (US)

( * ) Notice: Subject to any disclaimer, the term of this patent is extended or adjusted under 35 U.S.C. 154(b) by 0 days.

(21) Appl. No.: 09/795,284

(22) Filed: Feb. 28, 2001

Related U.S. Application Data

(63) Continuation-in-part of application No. 09/561,126, filed on Apr. 28, 2000, now Pat. No. 6,286,465.

(51) Int. Cl.[7] ..... F22B 5/02

(52) U.S. Cl. ..... 122/18.31; 122/44.2; 122/155.2

(58) Field of Search ..... 122/13.01, 18.3, 122/18.31, 44.2, 155.2, 48; 138/38, 39; 165/109.1, 183; 29/890.046, 890.03

(56) References Cited

U.S. PATENT DOCUMENTS

| | | | |
|---|---|---|---|
| 349,060 | A | 9/1886 | Serve |
| 799,120 | A | 9/1905 | Way |
| 1,947,606 | A | 2/1934 | Lonergan |
| 2,057,154 | A | 10/1936 | Lonergan |
| 2,151,540 | A | 3/1939 | Varga |
| 2,550,965 | A | 5/1951 | Brown, Jr. |
| 2,677,394 | A | 5/1954 | Brinen et al. |
| 2,688,986 | A | 9/1954 | O'Brien |
| 2,826,220 | A | 3/1958 | Young |
| 2,929,408 | A | 3/1960 | Weatherwax et al. |
| 3,171,389 | A | 3/1965 | Throckmorton et al. |
| 3,397,440 | A | 8/1968 | Dalin |
| 4,263,878 | A | 4/1981 | Hurley et al. |
| 4,271,789 | A | 6/1981 | Black |
| 4,286,655 | A | 9/1981 | Trojani |
| 4,306,619 | A | 12/1981 | Trojani |
| 4,352,378 | A | 10/1982 | Bergmann et al. |
| 4,380,215 | A | 4/1983 | Mendelson |
| 4,466,567 | A | 8/1984 | Garrison |
| 4,705,106 | A | 11/1987 | Hornack et al. |
| 4,727,907 | A | 3/1988 | Duncan |
| 4,953,510 | A | 9/1990 | Akkala et al. |
| 4,953,535 | A | 9/1990 | Hagan |
| 5,372,188 | A | 12/1994 | Dudley et al. |
| 5,411,013 | A | 5/1995 | Kazen |
| 5,441,106 | A | 8/1995 | Yukitake |
| 5,544,625 | A | 8/1996 | Rivern |
| 5,575,273 | A | 11/1996 | Moore, Jr. |
| 5,666,942 | A | 9/1997 | Kazen |
| 5,704,417 | A | 1/1998 | Christensen et al. |

FOREIGN PATENT DOCUMENTS

| | | |
|---|---|---|
| WO | WO 98/28578 | 7/1998 |

*Primary Examiner*—Jiping Lu
(74) *Attorney, Agent, or Firm*—Michael Best & Friedrich LLP

(57) ABSTRACT

A water heater includes a water tank, a combustion chamber below the tank and communicating with the flue tube, and a flue system. The flue system includes a flue tube, and V-shaped fins that are metallurgically bonded to the flue tube wall to divide the flue tube into four flue chambers extending substantially parallel to the longitudinal axis of the flue tube. The V-shaped fins include radially extending apertures that reduce the thermal expansion of the V-shaped fins with respect to the flue tube to reduce stress at the joint between the fins and the flue tube. The flue system also includes a removable baffle hanging in each flue chamber. The baffles include adjustable turbulation surfaces to control the quality of combustion in the water heater.

30 Claims, 5 Drawing Sheets

WATER HEATER FLUE SYSTEM

This is continuation-in-part of application Ser. No. 09/561,126 filed Apr. 28, 2000 now U.S. Pat. No. 6,286,465, the entire contents of which are herein incorporated by reference.

FIELD OF THE INVENTION

The invention relates to flue systems for gas-fired water heaters.

BACKGROUND

It is known to weld or otherwise metallurgically bond fins inside a water heater flue tube to enhance heat conduction through the walls of the flue tube. It is also known to hang removable baffles in a flue tube to turbulate the exhaust gases flowing through the flue tube.

However, known systems often do not meet the current gas-fired water heater regulations relating to efficiency and construction for facilitating cleaning, and many of those water heaters that do meet the current regulations will not meet the next, more strict regulations to be enacted. For example, under today's regulations, the flue of a water heater has to be cleanable to remove soot and other buildup that may be hazardous. Many known flue systems were not designed to be easily cleaned, and therefore may not meet this regulation.

For example, one known flue tube fin arrangement includes a plurality of small fins extending radially inwardly into the flue tube from the flue tube wall. Soot can collect on these small fins, and the small fins are not easily cleaned with a brush. Another example is a twisted fin positioned within the flue tube. A twisted fin is not easily cleaned because a cleaning brush would have to be twisted to follow the contour of the fin.

SUMMARY

The present invention provides a flue system for a water heater. The flue system permits the combustion characteristics of the water heater to be tuned or adjusted. The system also permits relatively easy cleaning of the flue. The flue system includes a fin that is metallurgically bonded to the flue tube, and a removable baffle having at least one turbulation surface. The combustion quality of the water heater is adjusted by adding or removing baffles and by adjusting the turbulation surfaces of the baffles. The fin may be a cruciform-shaped fin, a pair of V-shaped fins, or a plurality of straight fins. Preferably, the fins divide the flue tube into flue chambers extending substantially parallel to the longitudinal axis of the flue tube, and the removable baffles are hung in selected flue chambers.

Other features and advantages of the invention will become apparent to those skilled in the art upon review of the following detailed description, claims, and drawings.

Figure 1:
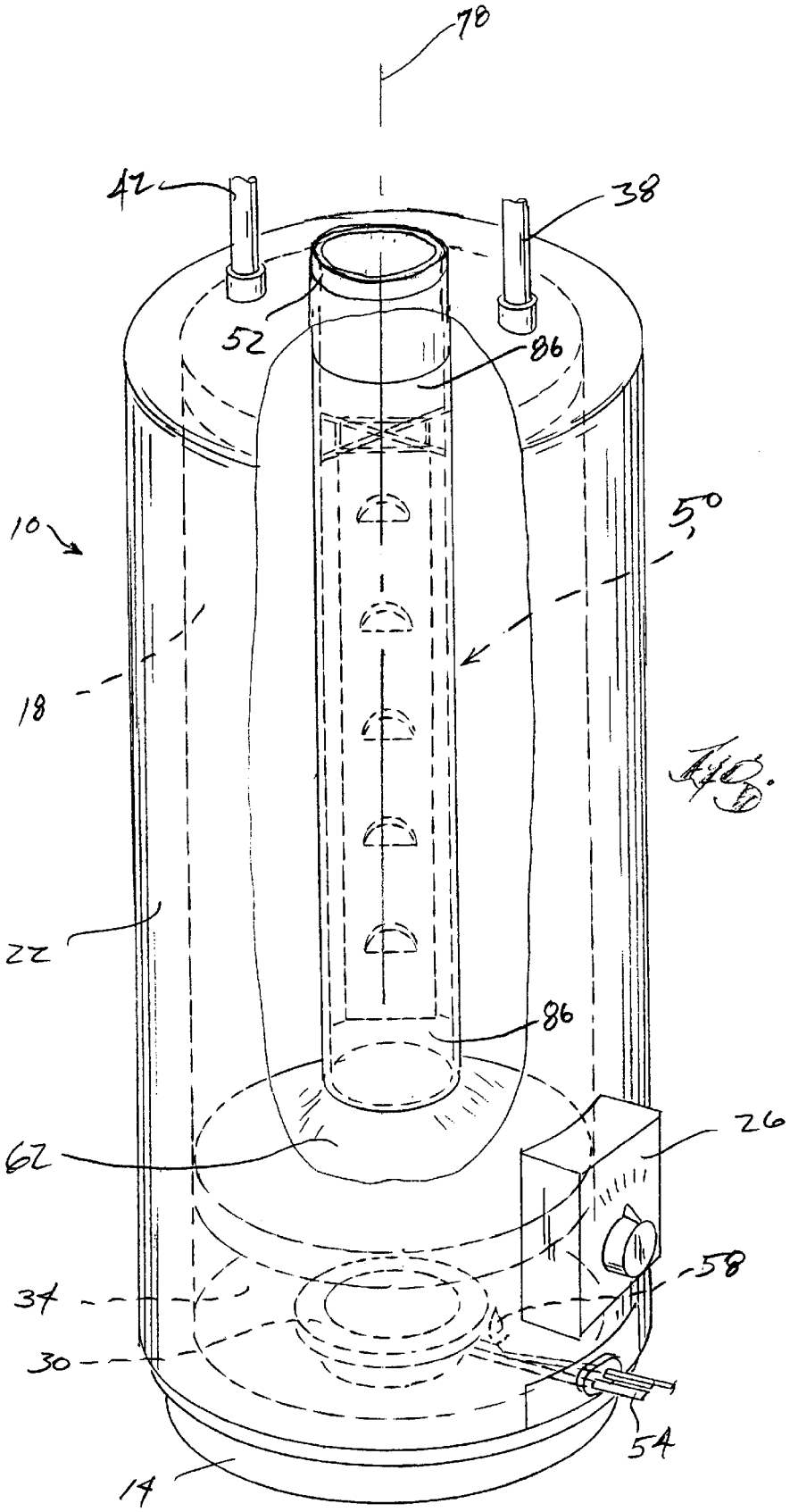
FIG. 1 is a perspective, partially cut-away view of a water heater embodying the present invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify elements of a method or process is simply for identification and is not meant to indicate that the elements should be performed in a particular order.

DETAILED DESCRIPTION

FIG. 1 illustrates a water heater 10 that includes a base pan 14, a tank 18 supported by the base pan 14 and containing water, an insulating jacket 22 surrounding the tank 18, a control system 26, a burner 30 disposed in a combustion chamber 34 beneath the tank 18, a water inlet pipe 38, a water outlet pipe 42, and a flue system 50 including a flue tube 52. In operation, gas fuel is provided to the burner 30 through a conduit 54. The gas is released by the burner 30 in a controlled fashion, and the gas is lit by a pilot light 58 that continually burns within the combustion chamber 34. Products of combustion from the burner 30 heat the water in the tank 18 through the tank bottom wall 62, which is dome-shaped. The products of combustion also flow up through the flue tube 52 and heat the water through the wall of the flue tube 52.

Figure 2:
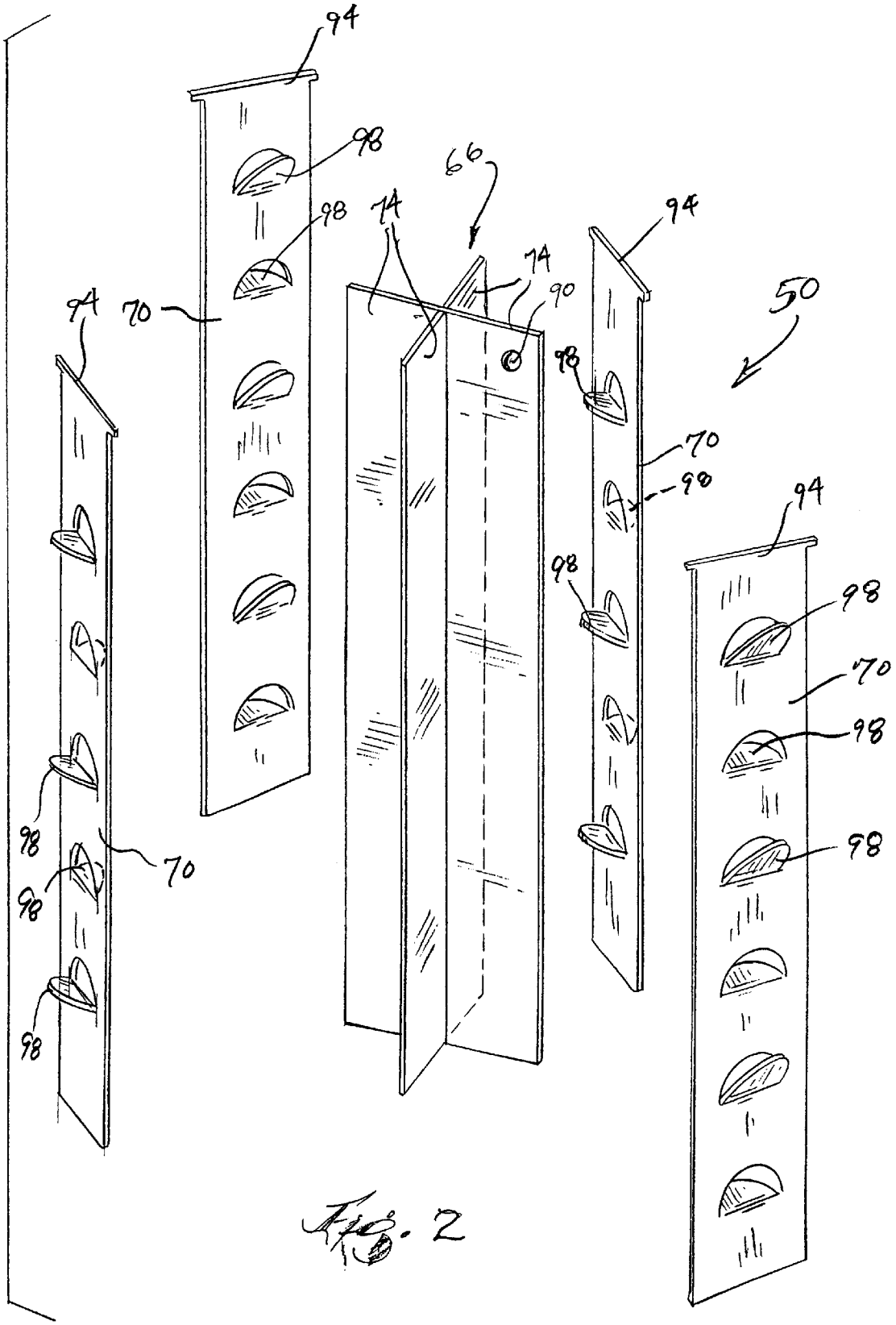
FIG. 2 is an enlarged exploded view of part of the flue system of FIG. 1.

FIG. 2 illustrates the flue system 50, which includes the flue tube 52 (FIG. 1), a fin structure 66, and four removable baffles 70. With additional reference to FIG. 3, the illustrated fin structure 66 is a cross-shaped or cruciform fin structure having four arms or fin portions 74 of substantially equal length joined along a central line that is substantially coincident with the longitudinal axis 78 of the flue tube 52.

Figure 3:
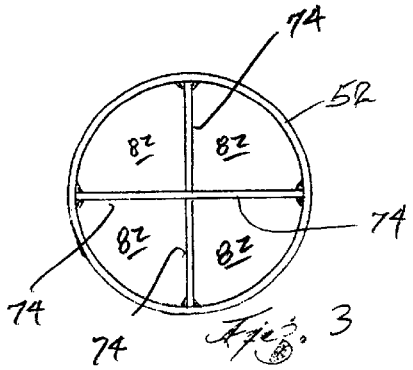
FIG. 3 is an end view of a flue tube including a first fin construction.

The outer edges of the fin portions 74 are metallurgically bonded to the inner surface of the flue tube wall as shown in FIG. 3. As used herein, "metallurgically bonded" means welded, brazed, or otherwise joined or fused together to facilitate heat conduction between two members. Preferably, the fin portions 74 are welded to the flue wall from the outside by penetration, laser, arc, or electron beam welding.

Alternatively, the fin portions 74 may be welded from inside the tube 52 with a torch. A continuous weld along the entire length of the edge of the fin portions 74 is not necessary. Rather, the fin portions 74 may be welded along only a portion of each edge, either in a continuous weld or in several segmented welds. In this regard, the fin portions 74 may be welded along 100% or less of the length of the edges. Preferably, the fin portions 74 are welded between about 75% and 100% of the length of the edges to provide the desired heat transfer efficiency. Preferably, the flue system 50 is made of mild (i.e., low carbon) steel. In high efficiency models where corrosion caused by condensation is a concern, the flue system 50 may be constructed of an alloy such as stainless steel, Inconel, or an alloy of nickel. Alternatively, any suitable material may be used to construct the flue system 50.

The cruciform fin structure 66 provides several advantages. First, the cruciform fin structure 66 provides structural stability to the flue tube 52, which aids in the manufacture of the flue system 50. The structural stability permits the flue tube 52 to resist distortion during the glass-firing process and during insertion of the flue tube 52 into heads during assembly.

The cruciform fin structure 66 also substantially equally divides the inner volume of the flue tube 52 into four flue chambers 82 that extend substantially parallel to the longitudinal axis 78 of the flue tube 52. The four flue chambers 82 act as four flue tubes of relatively small cross-sectional area. The hottest gas within each flue chamber 82 is geometrically centered in the cross-sectional area of the flue chamber 82. If there were no fin structure 66 in the flue tube 52, the hottest gas would be centered with respect to the cross-sectional area of the flue tube 52. A second advantage of the cruciform fin structure 66, therefore, is that the hottest gas is closer to the flue wall than if the fin structure 66 were not present or if the fin structure 66 did not divide the flue tube into separate flue chambers 82.

A third advantage of the cruciform fin structure 66 is that it facilitates cleaning the flue tube 52. A cleaning brush may be easily inserted into the four flue chambers 82, and no twisting of the brush is required.

Another advantage lies in the fact that the four fin portions 74 of the fin structure 66 are connected at the center of the fin structure 66. In this regard, if one of the welds along one of the edges were to fail, the fin structure 66 would still be supported by the welds on the other fin portion 74 edges.

As shown in FIG. 1, the fin structure 66 is positioned within the flue tube 52 to leave a space 86 between the ends of the fin structure 66 and the ends of the tube 52. The space 86 facilitates mounting the flue tube 52 and fin structure 66 assembly on a glass coating machine that coats the inside and outside of the flue tube 52 and the fin structure 66 with a protective glass coating to resist degradation of the fin structure 66 and flue tube wall. Additionally, because the fin structure 66 is recessed with respect to the lower end of the flue tube 52, the fin structure 66 is less likely to be overheated by the extreme temperatures in the combustion chamber 34. The space 86 may be, for example, about three inches, but may be more or less depending on the circumstances.

To further facilitate the glass-coating process, one or more fin portions 74 may include a hole 90. The hole 90 may be engaged with a hook to suspend the fin structure 66 and flue tube 52 during the heating procedure of glass coating. This is an advantage over providing a hole in the flue tube 52. Holes in the flue tube 52 can interfere with welding the flue tube 52 to the head of the tank 18 if the hole is located too far from the end of the flue tube 52. On the other hand, if the hole is positioned too close to the end of the tube 52, the hook may tear through the flue tube wall at the elevated temperatures of the heating procedure. Additionally, a hole in the flue tube 52 would have to be patched or otherwise closed, while the hole in the fin portion 74 would not interfere with the operation of the water heater 10.

Because the fin portions 74 are metallurgically bonded to the flue wall, heat transfer between the fin portions 74 and the flue wall is improved over fin portions that are not metallurgically bonded to the flue wall. The metallurgical bonding therefore results in more efficient transfer of heat from the products of combustion to the water in the tank 18. The increased heat transfer of the cruciform fin structure 66 permits a water heater 10 to be made more compact than multiple flue designs. There is less welding, fewer components, lower cost, and less tooling involved in assembling a water heater 10 having the cruciform fin structure 66 when compared to a multiple flue design.

As seen in FIG. 2, the baffles 70 are elongated and include hangers 94 and turbulation surfaces 98. The baffles 70 may be constructed from, for example, strips of stainless steel having partially cut-out tabs that are bent to form the turbulation surfaces 98. Preferably, the tabs 98 are bent in alternating directions along the length of the baffle 70 as illustrated. The tabs 98 may be semicircular in a shape as illustrated or any other suitable shape. The turbulation surfaces 98 cause turbulent flow in the products of combustion moving through the flue tube 52. The turbulation surfaces 98 can be adjusted to provide more or less resistance to the flow of products of combustion. The turbulation surfaces 98 also resist downdrafts in the flue tube 52.

In this regard, the flue system 50 is adjustable, and the quality of combustion in the water heater 10 is able to be tuned to optimize combustion, residence time of the products of combustion within the flue tube 52, and heat transfer to the water in the tank 18. The baffles 70 may also be removed and replaced with baffles 70 having different arrangements of turbulation surfaces 98 to optimize these parameters and to accommodate different inputs to the burner 30.

Figure 7:
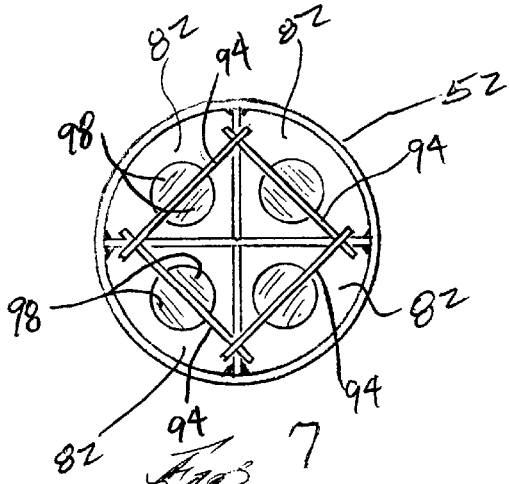
FIG. 7 is an end view of a flue tube including a first baffle orientation.
Figure 8:
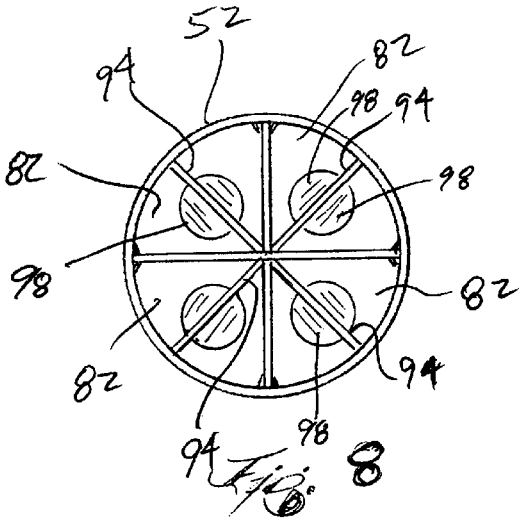
FIG. 8 is an end view of a flue tube including a second baffle orientation.

As can be seen in FIGS. 7 and 8, the baffles 70 may be supported with the hangers 94 in a square or chord pattern (FIG. 7), in a radial pattern (FIG. 8), or in a combination of the chord and radial patterns. Thus, the orientation in which the baffles 70 are hung may be used to further tune the combustion quality of the water heater 10. Also, one or more of the baffles 70 may be removed from the flue tube 52 to further customize the combustion quality.

Figure 9:
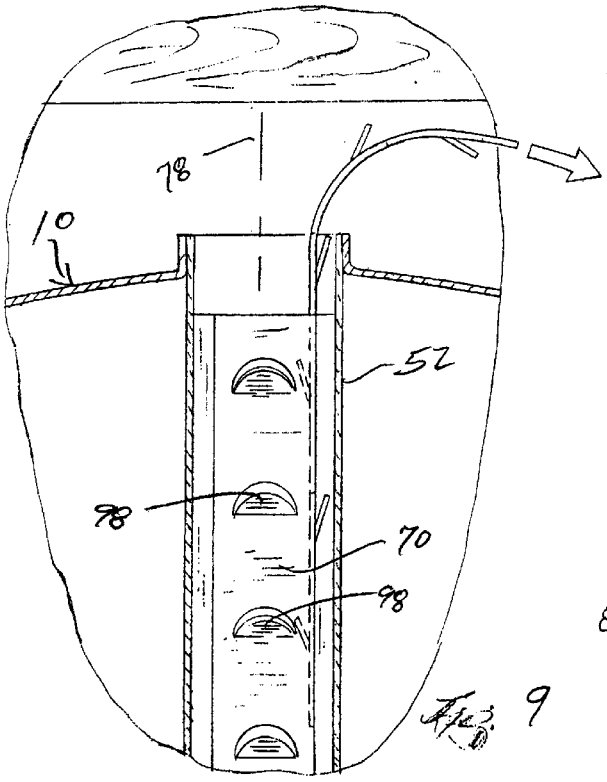
FIG. 9 is an enlarged view of the top portion of the water heater of FIG. 1, illustrating the removal of a baffle under low-clearance circumstances.

Referring now to FIG. 9, because the baffles 70 are made of relatively narrow strips of metal, they are more easily bent than traditional, larger baffles. As a result, the baffles 70 may be removed from a water heater 10 under low clearance conditions, where traditional, larger baffles could not be removed without first tipping or otherwise moving the water heater 10. The flue 52 and fin structure 66 are easily cleaned by removing the baffles 70 from the flue tube 52 and scrubbing the flue wall and fin structure 66 with a brush.

Figure 10:
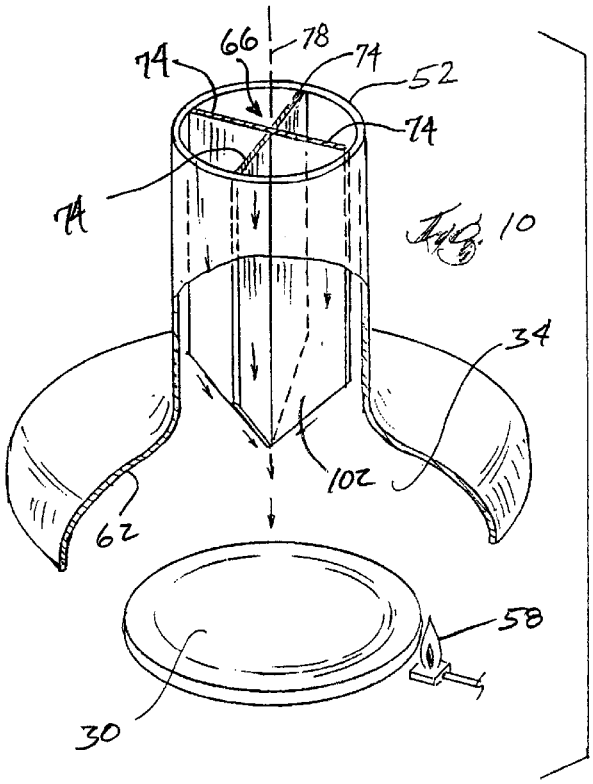
FIG. 10 is a perspective view of an alternative construction of the lower end of the fin structure.

An alternative design for the lower end of the fin structure 66 is illustrated in FIG. 10. Here it is shown that the end 102 of the fin structure 66 may be shaped as a point (e.g., shaped as the end of a pointed stake). As condensation forms in the flue tube 52, water runs down the fin structure 66. In a flue system having a flat-bottom fin structure, some of the condensation may run along the domed bottom wall 62 of the tank 18 and drip onto the pilot light 58, potentially extinguishing the pilot light 58. With the pointed end 102 design shown in FIG. 10, substantially all of the condensation runs all the way down the fin structure 66 to the pointed end 102, and falls on the burner 30, where the condensation is evaporated. The pointed end 102 of the fin structure 66 may therefore help to keep the pilot light 58 from being inadvertently extinguished.

Figure 11:
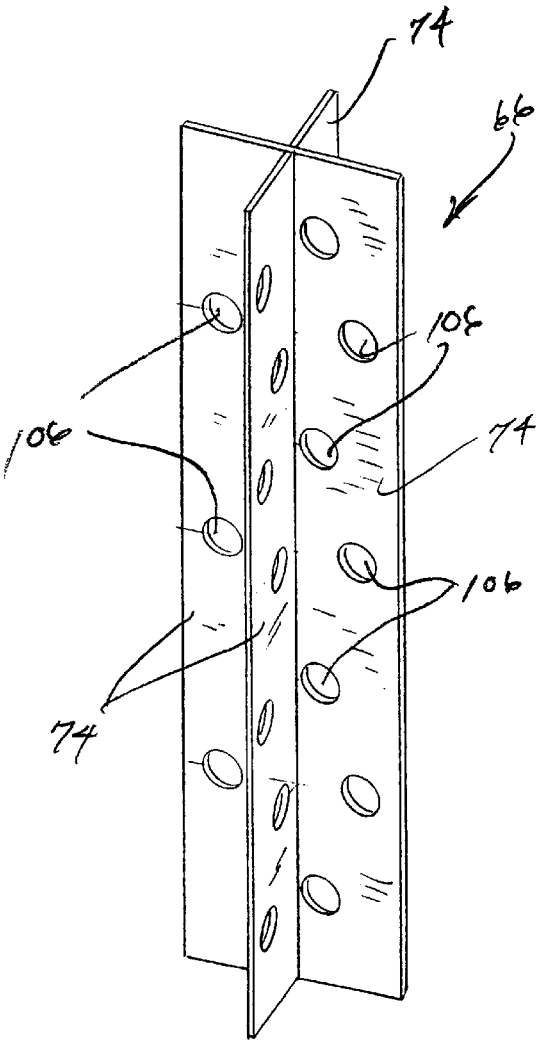
FIG. 11 is a perspective view of an alternative construction of the fin structure.

FIG. 11 illustrates another alternative construction of the fin structure 66. Here the fin structure 66 is provided with holes 106 to permit the cross-flow of the products of combustion through the fin structure 66. The holes 106 do not significantly interfere with cleaning the flue tube 52 and fin structure 66. The cross-flow holes 106 permit better mixing of the products of combustion.

Additionally, the holes 106 in the fin structure 66 illustrated in FIG. 11 may be provided by shear-forming tabs in a similar fashion to the tabs 98 of the baffle 70 described above. The tabs may be bent in alternating directions. In such a construction, the hanging baffles 70 would not be necessary, as the bent tabs formed in the fin structure 66 would serve as turbulation surfaces. The tabs would provide a greater and more efficient heat transfer surface than the fin structure 66 illustrated in FIG. 11.

Figure 4:
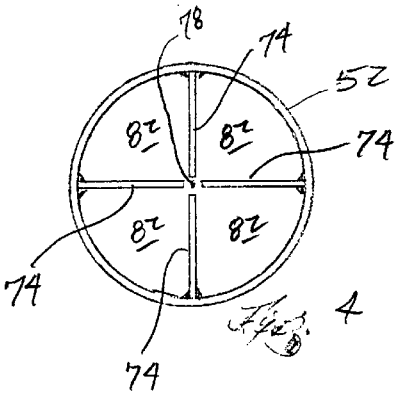
FIG. 4 is an end view of a flue tube including a second fin construction.
Figure 5:
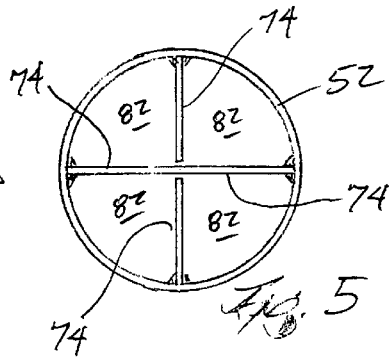
FIG. 5 is an end view of a flue tube including a third fin construction.
Figure 6:
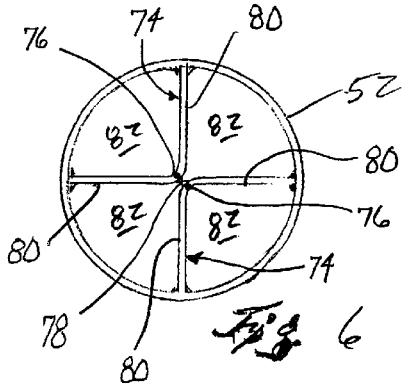
FIG. 6 is an end view of a flue tube including a fourth fin construction.

Alternative fin structure 66 configurations are illustrated in FIGS. 4–6. Each alternative fin structure 66 configuration includes a plurality of fin portions 74. In each configuration, however, the fin portions 74 substantially divide the flue tube 52 into four flue chambers 82. In each configuration, the fin portions 74 may be sized so that they abut each other near the center of the flue tube 52, or the fin portions 74 may be intentionally sized to not quite touch each other. If the fin portions 74 do not touch each other, the space between the inner edges of the fin portions 74 acts as a buffer, absorbing any distortion of the flue tube 52, and permitting the flue tube 52 to be radially compressed before the fin portions 74 touch each other and provide support for the flue wall.

In FIG. 4, the outer edge of each of four fin portions 74 is metallurgically bonded to the flue wall. The inner edge of each fin portion 74 is positioned near the longitudinal axis 78 of the flue tube 52.

In FIG. 5, three fin portions 74 are provided, one of which is metallurgically bonded to the flue wall along both edges, and two that each have one edge metallurgically bonded to the flue wall. The two fin portions 74 that have free ends may or may not touch the fin portion 74 that is metallurgically bonded at both ends.

FIG. 6 illustrates a configuration with two fin portions 74, in which the fin portions 74 are V-shaped in cross-section. The V-shaped fin portions 74 each include a longitudinally extending point, or base 76 and two legs 80 that extend away from the base 76. The base 76 defines a substantially vertical line that is substantially parallel to the longitudinal axis 78 of the flue tube 52. Each leg 80 is substantially planar and includes an edge that is metallurgically bonded to the inner surface of the flue tube 52. The V-shaped fin portion 74 is preferably welded to the inner surface on one side of each leg 80, but may alternatively be welded on both sides of each leg 80. The bases 76 of the V-shaped fin portions 74 are positioned near each other substantially along the longitudinal axis 78 of the flue tube 52 and preferably within approximately 0.030 inches from each other. The lines defined by the bases 76 of the two fin portions 74 may define a plane that includes the longitudinal axis 78. The V-shaped fin portions 74 may alternatively be welded along the longitudinal axis 78 at their respective bases 76.

Figure 12:
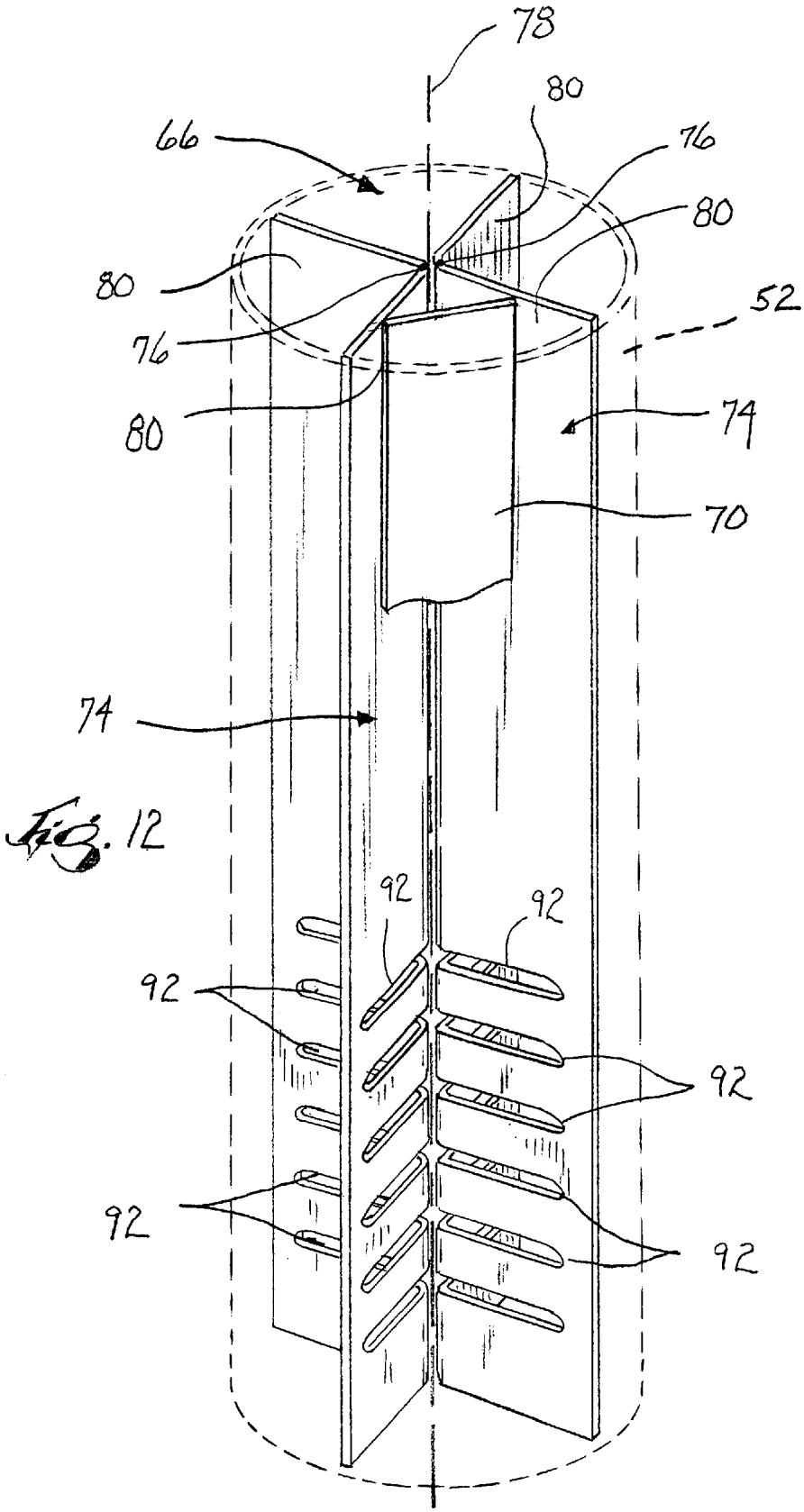
FIG. 12 is a perspective view of an alternative construction of the fin structure.

FIG. 12 illustrates another fin structure 66 that includes V-shaped fin portions 74 having at least one slot 92 to reduce cracking effects caused by the thermal expansion of the fin structure 66. The fin structure 66 is welded or otherwise metallurgically bonded to the inside surface of the flue tube 52. Differences between the thermal expansion of the flue tube 52 and that of the fin structure 66 may develop thermal stresses at the weld joint between the V-shaped fin portion 74 and the flue tube wall. The number and the location of the slots 92 can be varied to reduce the thermal stress on the fin portions 74 at the joints while accommodating the actual thermal growth in the V-shaped fin portions 74.

As shown in FIG. 12, the six slots 92 are preferably cut horizontally across each V-shaped fin portion 74. The ends of the slots 92 are rounded to avoid high stress concentrations that could lead to crack propagation. The slots 92 project an equal distance from the base 76 of the fin portion 74 along each leg 80 to within ⅜ of an inch from the edge of each leg 80. The slots 92 may alternatively be asymmetrical with respect to the base 76, and extend further along one leg 80 than the other leg 80. The slots 92 may also alternatively be angled with respect to horizontal and may be longer, shorter, wider, or narrower than illustrated to optimize heat transfer while still minimizing the stresses due to thermal expansion. It should also be noted that the baffles 70 illustrated in FIGS. 1, 2, and 7–9 and described above may be used with the fin structure 66 illustrated in FIG. 12 (one baffle 70 is partially shown in FIG. 12).

In an alternative embodiment, the total length of the V-shaped fin portion 74 is 39⅝ inches. The lowest slot 92 is preferably 4 13/16 inches away from the bottom end of the fin portion 74 and all of the slots 92 are equally spaced approximately 6 inches apart from each other such that the top slot is also 4 13/16 inches away from the top end of the fin portion 74. By way of this configuration, the V-shaped fin portion can be oriented in either direction before being inserted into the flue tube 52 during assembly.

Although all of the fin structure 66 configurations illustrated herein substantially divide the flue tube 52 into four flue chambers 82, other fin structure configurations are contemplated. For example, a fin structure configuration could be provided in which the flue tube is divided into less than or more than four flue chambers 82 (e.g., with only one V-shaped fin portion or with more than two V-shaped fin portions).

What is claimed is:

1. A water heater comprising:

a tank for holding water;

a combustion chamber;

a flue tube extending through the tank and communicating with the combustion chamber, the flue tube having an inner surface and a longitudinal axis; and a fin structure positioned within the flue tube, the fin structure including at least one fin portion that is V-shaped in cross-section and that has a base extending substantially parallel to the longitudinal axis, the fin portion also having two legs that extend from the base and that are each metallurgically bonded to the inner surface to define a joint between each of the legs and the inner surface, and the fin portion also having at least one slot to reduce the amount of thermal expansion of the fin structure at the joints, the fin structure dividing the flue tube into a plurality of flue chambers extending substantially parallel to the longitudinal axis.

2. The water heater of claim 1 wherein the longitudinal axis is substantially vertical, and wherein the combustion chamber is located beneath the tank.

3. The water heater of claim 1 wherein the base is substantially collinear with the longitudinal axis.

4. The water heater of claim 1 wherein the at least one slot includes a plurality of slots that are equally spaced approximately 6 inches apart from each other along the length of the fin portion.

5. The water heater of claim 1 wherein the slot extends an equal distance from the base along each of the legs.

6. The water heater of claim 1 wherein the slot is substantially horizontal.

7. The water heater of claim 1 wherein the at least one fin portion includes first and second fin portions, the bases of the fin portions being metallurgically bonded to one another such that the legs of the first fin portion extend substantially different directions than the legs of the second fin portion.

8. The water heater of claim 7 wherein the bases and the longitudinal axis are all substantially coplanar.

9. The water heater of claim 1 wherein the at least one fin portion includes first and second fin portions, the bases of the fin portions being spaced from each other such that the legs of the first fin portion extend substantially different directions than the legs of the second fin portion.

10. The water heater of claim 1 further comprising a removable baffle positioned within one of the flue chambers, the baffle having at least one turbulation surface.

11. A water heater comprising:

a tank for holding water;

a combustion chamber;

a flue tube extending through the tank and communicating with the combustion chamber, the flue tube having an inner surface and a longitudinal axis; and a fin structure positioned within the flue tube, the fin structure including at least one fin portion that is V-shaped in cross-section and that has a base extending substantially parallel to the longitudinal axis, and the fin portion also having two legs that extend from the base and that are each metallurgically bonded to the inner surface to define a joint between each of the legs and the inner surface, the legs being approximately 90 degrees apart from each other, the fin structure dividing the flue tube into a plurality of flue chambers extending substantially parallel to the longitudinal axis, wherein the fin portion includes at least one slot to reduce the amount of thermal expansion of the fin structure at the joint.

12. The water heater of claim 11 wherein the longitudinal axis is substantially vertical and the combustion chamber is located beneath the tank.

13. The water heater of claim 11 wherein the base is substantially collinear with the longitudinal axis.

14. The water heater of claim 11 wherein the at least one fin portion includes first and second fin portions, the bases of the fin portions being metallurgically bonded to one another such that the legs of the first fin portion extend substantially different directions than the legs of the second fin portion.

15. The water heater of claim 14 wherein the bases and the longitudinal axis are all substantially coplanar.

16. The water heater of claim 11 wherein the at least one fin portion includes first and second fin portions, the bases of the fin portions being spaced from each other such that the legs of the first fin portion extend substantially different directions than the legs of the second fin portion.

17. The water heater of claim 11 further comprising removable baffle positioned within one of the flue chambers, the baffle having at least one turbulation surface.

18. A water heater comprising a water tank, a combustion chamber, a flue extending from the combustion chamber and through the tank, the flue having an inside and an inner surface, and a fin structure in the flue for improving heat transfer from exhaust gases in the flue to water in the tank, the fin structure having a longitudinal direction, a V-shaped cross section transverse to the longitudinal direction, a longitudinally extending point, and a pair of longitudinally extending, spaced edges secured to the inner surface of the flue so as to facilitate heat transfer from the fin structure to the flue, the fin structure dividing the inside of the flue into two longitudinally extending flue portions through which exhaust gases can flow, and the fin structure being slotted to reduce adverse effects of thermal expansion of the fin structure.

19. A water heater as set forth in claim 18 wherein the edges are welded to the inner surface of the flue.

20. A water heater as set forth in claim 18 wherein the fin structure has two legs of substantially equal length extending from the point, each of the legs being substantially planar and including a respective one of the edges.

21. A water heater as set forth in claim 18 wherein the point is located substantially in the center of the flue.

22. A water heater as set forth in claim 18 wherein the combustion chamber is beneath the tank, wherein the flue and the point extend substantially vertically, and wherein the fin structure has two legs extending from the point, each of the legs defining a substantially vertical plane and including a respective one of the edges.

23. A water heater as set forth in claim 18 and further comprising a baffle in one of the flue portions.

24. A water heater as set forth in claim 23 and further comprising a baffle in the other of the flue portions.

25. A water heater as set forth in claim 18 wherein the fin structure has therein a plurality of slots.

26. A water heater as set forth in claim 25 wherein each of the slots extends through the point of the fin structure.

27. A water heater as set forth in claim 26 wherein the fin structure has two legs of substantially equal length extending from the point, each of the legs being substantially planar and including a respective one of the edges, and wherein each of the slots extends substantially the same distance into both legs.

28. A water heater as set forth in claim 25 wherein the slots are substantially equally spaced along the fin structure.

29. A water heater as set forth in claim 25 wherein the combustion chamber is beneath the tank, wherein the flue and the point extend substantially vertically, wherein the fin structure has two legs extending from the point, each of the legs defining a substantially vertical plane and including a respective one of the edges, and wherein the slots are substantially horizontal.

30. A water heater as set forth in claim 29 wherein each of the slots has a height that is constant along substantially the entire horizontal extent of the slot.

* * * * *